United States Patent [19]

Tomibe et al.

[11] 4,378,226

[45] Mar. 29, 1983

[54] ELECTRICALLY CONDUCTING FIBER AND METHOD OF MAKING SAME

[75] Inventors: Shinje Tomibe, Kyoto; Reizo Gomibuchi, Uji; Kiyofumi Takahashi, Yawata, all of Japan

[73] Assignee: Nihon Sanmo Dyeing Co., Ltd., Kyoto, Japan

[21] Appl. No.: 260,129

[22] Filed: May 4, 1981

Related U.S. Application Data

[63] Continuation-in-part of Ser. No. 183,639, Sep. 3, 1980.

[30] Foreign Application Priority Data

| | | | |
|---|---|---|---|
| Oct. 9, 1978 | [JP] | Japan | 53-124398 |
| Mar. 5, 1980 | [JP] | Japan | 55-28386 |
| Jun. 3, 1980 | [JP] | Japan | 55-74752 |
| Jul. 15, 1980 | [JP] | Japan | 55-92128 |

[51] Int. Cl.[3] ..... D06M 11/04; D06M 13/34; D06M 13/54; D06P 3/70

[52] U.S. Cl. ..... 8/491; 8/115.5; 8/116 R; 8/120; 8/127.5; 8/127.6; 8/128 R; 8/192; 8/193; 8/194; 8/624; 427/121; 427/343; 428/361; 428/373; 428/374; 428/379; 428/392; 428/393; 428/394; 428/395

[58] Field of Search ..... 8/115.5, 116 R, 192, 8/193, 127.5, 128 R, 491, 194, 120, 127.6, 495, 624; 427/121, 343; 428/361, 373, 374, 379, 392, 393, 394, 395

[56] References Cited

U.S. PATENT DOCUMENTS

| | | | |
|---|---|---|---|
| 2,743,991 | 5/1956 | Schoonover . | |
| 2,749,210 | 6/1956 | Gray | 427/343 |
| 2,779,726 | 1/1957 | Rochester et al. . | |
| 3,014,818 | 12/1961 | Campbell . | |
| 3,416,874 | 12/1968 | Robin . | |
| 3,790,341 | 2/1974 | Makhkamov et al. . | |
| 3,940,533 | 2/1976 | Arsac | 428/395 |
| 3,958,066 | 5/1976 | Imamura et al. . | |
| 4,122,143 | 10/1978 | Momotori et al. . | |

FOREIGN PATENT DOCUMENTS

| | | |
|---|---|---|
| 74056 | 1/1893 | Fed. Rep. of Germany . |
| 2329484 | 12/1973 | Fed. Rep. of Germany . |
| 644429 | 5/1928 | France . |
| 55-51873 | 4/1980 | Japan . |
| 1372656 | 11/1974 | United Kingdom . |
| 1396072 | 5/1975 | United Kingdom . |

*Primary Examiner*—James C. Cannon

*Attorney, Agent, or Firm*—Fisher, Christen & Sabol

[57] ABSTRACT

Electrically conducting fibers are prepared by introducing cyanic groups into a synthetic or natural starting fiber and then subjecting the fiber to a heat treatment with a copper compound, a reducing agent capable of reducing bivalent copper ions to monovalent copper ions, and a sulfur-containing compound capable of discharging a sulfur atom or sulfur ion for reaction with monovalent copper ions adsorbed by the fiber so that copper sulfide is impregnated into the fibers. Heat treatment with the sulfur-containing compound can be simultaneous with or separate from heat treatment with the copper compound and reducing agent. The electrically conducting fibers of the present invention have excellent conductivity, improved washability and are not plagued by the problem of static charging associated with the starting synthetic or natural fiber.

23 Claims, No Drawings

ELECTRICALLY CONDUCTING FIBER AND METHOD OF MAKING SAME

RELATED APPLICATIONS

This application is a continuation-in-part of our copending U.S. application Ser. No. 183,639 filed Sept. 3, 1980.

BACKGROUND OF THE INVENTION

1. Field of the Invention

This invention relates to electrically conducting fibers impregnated with copper sulfide and to methods of making them.

2. Description of the Prior Art

Numerous methods for imparting electrical conductivity to synthetic polymeric fibers are known in the art. For example, one method for imparting electrical conductivity to polymeric fibers involves plating the surface of the fiber. However, this method requires etching of the surface of the fiber prior to plating so as to obtain satisfactory adhesion. The process also involves sensitizing and activating the fiber prior to plating. In addition, the resulting electrically conducting fiber differs greatly from the starting fiber in softness, flexibility, and smoothness.

In another prior art process, metal is kneaded into a polymer. The polymer is then spun into a yarn. However, this process is plagued by problems such as clogging of the nozzle with metallic particles during spinning. In addition, unless the metal content of the fibers is kept relatively low, the electrically conducting fiber obtained by this prior art method has inferior mechanical properties compared to the starting fiber.

In the third prior art process, metallic powder is deposited in the pores of a polymeric fiber. This method usually requires an extraordinarily porous fiber and intricate process steps.

In the U.S. Pat. Nos. 3,014,818 and 4,122,143 electrically conductive products are produced by reducing a copper compound to metallic copper. In U.S. Pat. No. 3,014,818, an electrically conductive fibrous material is produced by soaking the fiber, such as cotton or acrylic fibers, in a bath comprising a reducible salt of nickel, cobalt, copper, or iron. The fiber is then subjected to a reducing treatment to obtain free metal particles which are dispersed through the interior of the fiber. Sodium borohydride and hydroxylamine are disclosed as satisfactory reducing agents. In U.S. Pat. No. 4,122,143, cured products are obtained by reducing copper simultaneously with the curing of a resin. Imparting electrical conductivity to an already existing fiber is not disclosed.

In the above-described prior art processes, electrical conductivity is obtained by the presence of metallic copper in the polymeric material. However, it is well-known that acrylic or acrylic-series fibers, including modacrylic fibers, have a strong affinity for monovalent copper ions. It is believed that this results from coordinate bonding between the cyanic groups in the fiber and the monovalent copper ions. The absorption of monovalent copper ions into acrylic or acrylic-series fibers, including modacrylic fibers, turns the fibers yellowish. However, as determined by measurements of electrical resistance, etc., the fibers do not develop any electrical conduction at all.

In applicants' Japanese application Nos. Sho 53-124,398 and Sho 55-028386 and in their copending U.S. application Ser. No. 183,639, filed Sept. 3, 1980, electrically conducting acrylic fibers or fibers containing acrylic fibers are disclosed. In these applications, applicants take advantage of the strong affinity of the cyanic group for monovalent copper ions to impart electrical conductivity to the acrylic fiber or to acrylic-series fibers, such as modacrylic fibers. The acrylic fiber or acrylic-series fiber is treated to adsorb monovalent copper ions and at the same time, or in a subsequent step, the fiber is treated with a sulfur-containing compound to convert the adsorbed monovalent copper ions into cupric sulfide or cuprous sulfide.

According to the present invention, the strong affinity of the cyanic group for monovalent copper ions is also taken advantage of to impart electrical conductivity to fibers other than the acrylic fibers, and acrylic series fibers, including modacrylic fibers of the above-mentioned applications. The present invention provides electrically conducting synthetic or natural fibers having cyanic groups introduced therein having excellent electrical conducting properties and washability. The present invention also provides a method for making an electrically conductive fiber from a synthetic or natural fiber by introducing cyanic groups into the synthetic or natural fiber and then converting monovalent copper ions which are absorbed by the fiber containing the cyanic groups into cuprous or cupric sulfide.

SUMMARY OF THE INVENTION

Electrically conducting fibers having excellent conductivity which is not lost in repeated washings are obtained by introducing cyanic groups into a synthetic or natural fiber. The fiber containing the cyanic groups is reacted with a bivalent copper compound, a reducing agent capable of reducing the bivalent copper ions to monovalent copper ions, and a sulfur-containing compound so that the fiber containing the cyanic groups adsorbs monovalent copper ions and so that the adsorbed monovalent copper ions are converted into cupric or cuprous sulfide. The reaction with the sulfur-containing compound can be simultaneous with or subsequent to the reaction of the fiber with the bivalent copper compound and reducing agent. The electrically conductive fibers of the present invention comprise synthetic or natural fibers such as polyamide fibers, polyester fiber, rayon fiber, cupro-ammonium fiber, animal fiber, and vegetable fiber, which have been impregnated with copper sulfide through cyanic groups which have been introduced into the fiber. The touch and other physical characteristics of the starting synthetic or natural fibers is substantially preserved and the washability thereof is improved in the process of the present invention. The electrically conductive fibers of the present invention are not plagued by the problem of static electricity associated with the starting fibers. In addition, the electrically conductive fibers of the present invention can by dyed the same as the starting fiber.

DETAILED DESCRIPTION OF THE INVENTION

The cyanic radical is introduced into the synthetic or natural starting fiber by means of well-known methods such as by reaction with dicyandiamide, graft polymerization of acrylonitrile onto the starting fiber, cyanoethylization, mixed spinning, graft polymerized material spinning, blocked polymerized material spinning, and the like.

Exemplary of the starting fibers which can be used in the present invention are synthetic fibers such as polyamide fiber, polyester fiber, rayon fiber, cuproammonium fiber, vegetable fibers, such as cotton, animal fibers such as wool and silk, and blends thereof.

The starting fiber, which has been impregnated with cyanic groups, by graft polymerization with acrylonitrile for example, is then heat treated with a bivalent copper compound, a reducing agent, and a sulfur-containing compound to adsorb copper ion in the form of copper sulfide. The heat treatment with the sulfur containing compound can be simultaneous with or separate from heat treatment with the copper compound and reducing agent.

When the heat treatments are simultaneous, the fiber which has been impregnated with cyanic groups is immersed in a bath containing a bivalent copper compound, a reducing agent, and a sulfur-containing compound at a temperature of from about 80° C. to 120° C. Typical heat-treatment times are about 1 to 1½ hours. The bath can optionally contain an acid or a salt for adjusting the pH of the bath. Suitable acids for this purpose are inorganic acids such as sulfuric acid, hydrochloric acid, and phosphoric acid, organic acids such as citric acid and acetic acid, and mixtures thereof. Suitable salts are the salts of the above acids such as sodium citrate, sodium acetate, disodium hydrogen phosphate, and mixtures of salts. Mixtures of acids and salts, such as a mixture of citric acid and disodium hydrogen phosphate can also be used. The pH range is typically between about pH 1.5 to about pH 6.

In the embodiment of the present invention wherein the heat treatment with the sulfur containing compound is separate from the treatment with the copper compound and the reducing agent, the fiber which has been impregnated with the cyanic groups is heat treated in a bath containing a bivalent copper compound and a reducing agent at a temperature of about 80° C. to 120° C. so that monovalent copper ions are adsorbed by the fiber. Typical heat treatment times are about 1 to 1½ hours. The bath can optically contain an acid or a salt or mixtures, as above, for adjusting the pH as required. Suitable pH values are in the range of from about pH 1.5 to about pH 2.0.

Next, the sulfur containing compound can be added to the same bath, but preferably, the heat treated fibers are reacted with the sulfur containing compound in a separate bath. Preferably, the heat treated fibers are rinsed, with water for example, prior to heat-treatment with the sulfur-containing compound. The fibers containing adsorbed monovalent copper ions are heat-treated in the bath containing the sulfur-containing compound at a temperature of about 80° C. to about 120° C. to convert the adsorbed monovalent copper ions to copper sulfide. Typical heat-treatment times are about 1 to 1½ hours. The bath can optionally contain an acid or a salt, or mixtures, as above, for adjusting the pH as required. Suitable pH values are in the range of from about pH 5.5 to pH 6.0.

In each of the above methods, the heat-treating temperature for adsorbing monovalent copper ions and for converting the adsorbed monovalent copper ions into copper sulfide is generally about 80° C. to 120° C. Reaction temperatures above this range will shorten the reaction time but it is often at the expense of fiber strength. At heat-treatment temperatures below about 80° C. the reaction times become longer. However, in the method wherein the heat-treatments are simultaneous, the reactions for producing cuprous sulfide or cupric sulfide in the fiber proceed satisfactorily at temperatures below 80° C. However, at reaction temperatures below about 50° C., the reactions proceed too slowly.

Also, in each of the above methods, the fiber containing the adsorbed copper sulfide is thoroughly washed with water, for example, and dried.

The media which is used in each of the heat-treating baths is generally water. The ratio of the weight of the fiber to the weight of the bath is generally about 1:15 to about 1:20.

Suitable copper compounds which provide monovalent copper ions for adsorption by the fibers are cupric salts, such as cupric sulfate, cupric chloride, cupric nitrate and the like and chelate compounds of copper, and the like. Suitable reducing agents for inclusion in the bath are metallic copper, hydroxylamine sulfate, ferrous sulfate, ammonium vanadate, furfural, sodium hypophosphite, glucose and the like.

Suitable sulfur-containing compounds which are capable of discharging sulfur atoms or sulfur ions for reacting with the copper ion to form the cuprous or cupric sulfide which is adsorbed in the fibers are sodium sulfide, sulfur dioxide, sodium hydrogen sulfite, sodium pyrosulfite, sulfurous acid, dithionous acid, sodium dithionite, sodium thiosulfate, thiourea dioxide, hydrogen sulfide, rongalite C ($NaHSO_2 \cdot CH_2O \cdot 2H_2O$), rongalite Z ($ZnSO_2 \cdot CH_2O \cdot H_2O$) and the like and mixtures thereof. A sulfur-containing compound, such as sodium hydrogen sulfite, can serve as the reducing agent when used in combination with another sulfur-containing compound such as sodium thiosulfate.

When a gaseous sulfur-containing compound is used, it can be bubbled into the aqueous bath containing the fiber or it can be directly contacted with fibers having adsorbed monovalent copper ions. In the latter case, the fiber can be placed in a closed receptacle having a gas inlet. The gaseous sulfur containing compound, such as hydrogen sulfide or sulfur dioxide is typically fed into the receptacle as a saturated vapor, at about 105° C. for example, until the pressure within the receptacle reaches about 1.0 $kg/cm^2$ gauge pressure. After the reaction, the cooled fiber containing adsorbed copper sulfide is washed and dried.

The greater and quantity of copper sulfide the fiber is impregnated with, the better the electrical conductivity of the product fibers. However, if the copper sulfide content is too high, physical properties, such as fiber strength, are reduced. On the other hand, satisfactory electrical conductivity properties cannot be obtained at very low copper sulfide contents. In the practice of the present invention, the amount of copper sulfide to be adsorbed by the fiber should be from 1 to 30% by weight based upon the weight of the starting fiber.

Accordingly, the amounts of the copper compound, the reducing agent, and the sulfur-containing compound should be sufficient to provide an amount of adsorbed copper sulfide within the above weight percentage range and are readily determined by one ordinarily skilled in the art.

Electrically conducting fibers obtained by the process of the present invention were analyzed by X-ray defraction techniques for the determination of the crystal structure of the adsorbed copper sulfide. It was ascertained that the copper sulfide was adsorbed within the fibers in the form of digenite (empirical formula: $Cu_9S_5$).

Adsorption of the cuprous sulfide or cupric sulfide within the whole fiber results in a fiber which possesses excellent electrical conductivity and improved washability over the starting synthetic or natural fiber. Furthermore, the touch and physical properties of the starting fiber is substantially preserved in the process of the present invention. In addition, the electrically conducting fibers of the present invention can be dyed the same as the starting fiber. Electrically conducting fibers produced by the metal plating method cannot be dyed. Typically, the electrically conducting polyamide fibers of the present invention are dyed in an aqueous solution containing the acid metal complex reactive chrome dye at a temperature of about 100° C. for about 30 minutes to 1 hour.

The electrically conducting fiber of the present invention lends itself to numerous applications in many fields. A given electrically conductive fiber of the present invention can be used alone or in combination with other electrically conductive fibers and/or with nonconductive fibers to produce woven or knitted fabrics. Combining of the fibers can be by techniques such as mixed spinning. The fabrics can be used for producing electric blankets, electrically heated clothing, and the like. Excellent control over the electrical properties of knitted or woven goods is obtained by combining the electrically conductive fibers of the present invention with other nonconductive synthetic fibers. For example, a small amount of the electrically conductive fibers of the present invention can be mingles into knitted or woven goods in the form of filament fibers. Also, spun yarns can be produced from mixtures of the electrically conductive fibers of the present invention with other synthetic fibers which are both in the form of staple fibers. The electrically conductive fibers of the present invention, taken alone or in combination with other fibers solve the conventional problem of static charging associated with clothing and carpets made from synthetic fibers such as polyamide fiber and polyester fiber.

The invention is illustrated but not limited by the following examples in which all parts, percentages, and proportions are by weight and all temperatures are in °C. unless otherwise indicated.

EXAMPLE 1

Nylon staple (3 denier, cut length 76 mm, manufactured by Toray, Ltd.) is rinsed in warm water kept at a temperature of 50° C. to remove any oil and grease from it. Then, it is immersed in a bath which is a water solution comprising 50 wt. % of acrylonitrile, 1.2 wt. % of ammonium persulfate, and 3 wt. % of sodium hydrogen sulfite, based upon the weight of the nylon. The ratio of the nylon staple weight to the weight of the bath is 1:20. The bath is gradually heated up to 70° C. from room temperature and the fiber is treated at that temperature for 60 minutes. After that, it is rinsed well in warm water and then in cold water to remove any nonreacted matter, by-products, and catalysts, etc. from it completely. Upon analysis of the washed product, it was found that the graft polymerization ratio of acrylonitrile with said nylon staple was 10%.

Next, the acrylonitrile grafted nylon staple is immersed in a bath which is a water solution comprising 10 wt. % of cupric sulfate, 10 wt. % of sodium thiosulfate, and 5 wt. % of sodium hydrogen sulfite, based upon the weight of the nylon. The ratio of the weight of the nylon staple of the weight of the bath is 1:20. The bath is gradually heated up to 100° C. from room temperature and is heated at that temperature for 60 minutes. After that, it is rinsed well in cold water and then is dried completely to obtain an olive-gray nylon staple.

Through X-ray analysis of the nylon staple obtained thereby, the line of diffraction (interfacial distance: 1.97 Å, 3.21 Å, and 2.79 Å) was found to be of digenite, a form of copper sulfide (empirical formula: $Cu_9S_5$). The copper ions were dispersed through and adsorbed by said nylon staple in the form of copper sulfide.

Through measurement of the electrical resistivity of said olive-gray nylon staple, the resistivity was found to be $4\times10^{-1}$ Ω-cm and the content of copper sulfide impregnated into said nylon staple was found to be 3.5% by weight.

EXAMPLE 2

Nylon staple impregnated with acrylonitrile as in Example 1 is immersed in a bath which is a water solution comprising 20 wt. % of cupric sulfate and 10 wt. % of hydroxylamine sulfate, based upon the weight of the nylon. The ratio of the weight of the nylon staple of the weight of the bath is 1:15. It is gradually heated up to 100° C. from room temperature and is treated at that temperature for 60 minutes. After the treatment, it is rinsed well in cold water.

After the rinsing step, the nylon staple is immersed in a bath which is a water solution comprising 10 g/l of sodium dithionite, 10 g/l of citric acid, and 22 g/l of disodium hydrogen phosphate. The bath is gradually heated up to 100° C. from room temperature. The nylon staple is treated at that temperature for 90 minutes. After the heat treatment, it is rinsed well in cold water and then dried completely.

The nylon staple obtained thereby has an olive-brown color and its electrical resistivity was found to be $8.5\times10^{-2}$ Ω-cm. The content of copper sulfide was found to be 6% by weight.

EXAMPLE 3

Nylon BCF (1300 denier, 64 filaments, manufactured by Toyo Boseki, Ltd.) is cleaned to completely remove any oil and grease from it. Then, it is immersed in a bath which is a water solution comprising 50 wt. % of acrylonitrile, 1.2 wt. % of ammonium persulfate, and 3.0 wt. % of sodium hydrogen sulfite, based upon the weight of the nylon fiber. The ratio of the fiber weight to the water weight containing the chemicals was 1:20. The water solution was then gradually heated up to 70° C. from room temperature. The nylon was heat treated at that temperature for 60 minutes.

After the heat treatment, the fiber is rinsed well in cold water to completely remove any non-reacted matter, by-products, and catalysts.

Next, the cleaned fiber is immersed in a bath which is a water solution comprising 15 wt. % of cupric sulfate and 15 wt. % of sulfuric acid, based upon the weight of the fiber. The ratio of the fiber weight to the bath weight is 1:20. A copper sieve (No. 31, 12 meshes) in an amount of 80% by weight of the fiber weight is added to the bath. Then, the water solution is gradually heated up to 100° C. from room temperature and the fiber is heat treated at that temperature for 60 minutes.

After the heat treatment, the fiber is immersed in a bath which is a water solution comprising 3.3 g/l sodium sulfide and 10 g/l disodium hydrogen phosphate. The bath is gradually heated up to 90° C. from room temperature and kept at that temperature for 90 minutes.

The fiber obtained thereby has an olive-green color and its electrical resistivity was found to be $8.3\times10^{-1}$ Ω-cm. The content of copper sulfide was found to be 2.8% by weight.

EXAMPLE 4

Polyester fiber (3 denier, cut length 80 mm bias, Type T-981, manufactured by Toray, Ltd.) is cleaned well and is immersed in a bath which is a solution comprising 50 wt. % of acrylonitrile, 1 wt. % of benzoyl peroxide, and 5 wt. % of Noigen SS emulsifier (a nonylphenol type of nonionic surfactant, manufactured by Daiichi Kogyo Seiyaku, Ltd.) based upon the weight of said fiber. The ratio of the fiber weight to the weight of the bath is 1:15. The solution is gradually heated up to 105° C. from room temperature and the fiber is heat treated at that temperature for 90 minutes.

After the heat treatment, the fiber is rinsed well in cold water to completely remove any non-reacted matters, by-products, and catalyst.

Next, the cleaned fiber is immersed in a bath which is a water solution comprising 10 wt. % of cupric sulfate, 10 wt. % of sodium thiosulfate, and 10 wt. % of hydroxylamine sulfate based upon the weight of the fiber. The ratio of the fiber weight to the bath weight is 1:20. The bath is gradually heated up to 100° C. from room temperature. The bath is heat treated at 100° C. for 60 minutes. After the heat treatment, the fiber is rinsed well in cold water and is dried completely.

The treated polyester fiber has an olive color and its electrical resistivity was found to be $2\times10^{-1}$ Ω-cm.

Additionally, it was found that the acrylonitrile used for the treatment of the fiber was introduced into said polyester fiber in an amount of 8.2% by weight of the fiber through the graft polymerization mentioned above.

EXAMPLE 5

Polyester fiber grafted with cyanic radical in the same manner as in Example 4 is immersed in a bath which is a water solution comprising 15 wt. % of cupric chloride and 7.5 wt. % of hydroxylamine sulfate, based upon the weight of the grafted fiber. The ratio of the weight of the fiber to the weight of the bath is 1:15. The fiber is heat treated at a bath temperature of 100° C. for 60 minutes.

After the heat treatment, the fiber is rinsed well in cold water and then is immersed in a bath which is filled with a water solution comprising 8 g/l of sodium thiosulfate, 8 g/l of citric acid, and 20 g/l of disodium hydrogen phosphate. The ratio of the fiber weight to the weight of the bath is 1:15. The fiber is heat treated at a bath temperature of 100° C. for 90 minutes. After the heat treatment, the fiber is rinsed well in cold water and then is dried completely.

The treated polyester fiber has an olive-green color and its electrical resistivity was found to be $3\times10^{-1}\Omega-$cm. The content of copper sulfide was found to be 3.0% by weight.

EXAMPLE 6

Rayon staple (2 denier, cut length 51 mm, Type KRP, manufactured by Kojin, Ltd.) is immersed in a bath which is a water solution of 2 wt. % of sodium hydroxide. The bath is kept at room temperature for 15 minutes and then the fiber is squeezed by means of mangles to 100% of wet pickup.

Next, said fiber treated as mentioned above is immersed in a bath which is a solution comprising 50 g/l of acrylonitrile. The ratio of the fiber weight to the weight of the bath is 1:20. The bath is kept at a temperature of 55° C. for 90 minutes for additional treatment of the fiber.

Then, after neutralizing the fiber with alkali, any nonreacted matters and by-products are removed from it completely.

The cyanoethylized ratio through the reaction mentioned above was found to be 8%.

The treated fiber is then immersed in a bath which is filled with a water solution comprising 10 wt. % of cupric sulfate, 10 wt. % of sodium thiosulfate, and 5 wt. % of hydroxylamine sulfate based upon the weight of the fiber. The ratio of the fiber weight to the weight of the bath is 1:20. The fiber is treated at a bath temperature of 80° C. for 90 minutes and then is rinsed well in cold water and dried completely.

The fiber obtained thereby exhibits an electrical resistivity of 1.0 Ω-cm and the content of copper sulfide is 2.8% by weight.

Also, in treating cupro-ammonium fiber in place of the rayon staple mentioned above, the same result as that obtained above has been obtained.

EXAMPLE 7

After adjusting the pH of a water solution comprising 50 g/l of dicyandiamide and 300 g/l of formalin (formaldehyde 30% of water solution) to be pH 10 with sodium carbonate, it is subjected to a methylol reaction at a temperature of 80° C. for 3 hours to obtain a reaction product for use in the treatment of cotton.

Cotton which is scoured through immersion in a bath which is filled with a water solution comprising 10 g/l of sodium hydroxide kept at a temperature of 100° C. for 60 minutes is cooled and immersed in another bath which is filled with a water solution comprising 100 g/l of said reaction product and 10 g/l of ammonium chloride at room temperature. Then, it is squeezed by means of mangles to 90% of wet pickup and is preliminarily dried at a temperature of 80° C. Then, the cotton is subjected to heat treatment at a temperature of 180° C. for 3 minutes.

The heat treated cotton is immersed in a bath which is a water solution comprising 15 wt. % of cupric sulfate, 10 wt. % of sodium thiosulfate, and 10 wt. % of sodium hydrogen sulfite based upon the weight of the cotton. The ratio of the weight of the cotton of the weight of the water solution is 1:20. The water solution is gradually heated up to 80° C. from room temperature and it is kept at that temperature for 90 minutes for treatment of the cotton. The treated cotton is rinsed well in cold water and is dried completely.

The cotton fiber obtained thereby exhibits a khaki color and its electrical resistivity was found to be 3.6 Ω-cm. The content of copper sulfide was found to be 2.5% by weight.

EXAMPLE 8

Wool (64's Top) is rinsed well in a bath which is filled with a solution comprising 2 ml/l of Niogen SS (Nonyl phenol type of nonionic surfactant, manufactured by Daiichi Kogyo Seiyaku, Ltd.) at a temperature of 60° C. to remove any oil and grease from it. Then, it is immersed in a bath which is a solution comprising 50 wt. % of acrylonitrile, 1.2 wt. % of ammonium persulfate, and 3 wt. % of sodium hydrogen sulfite based upon the weight of the wool. The ratio of the weight of the wool to the weight of the bath is 1:20. The bath is gradually heated up to 60° C. from room temperature, and the wool is treated at that temperature for 90 minutes. After the treatment, the wool is rinsed well in warm water and then in cold water to completely remove any unreacted materials, by-products, and catalysts from it.

Then, the cleaned wool is immersed in another bath which is a water solution comprising 10 wt. % of copper sulfate and 10 wt. % of sulfuric acid and 80 wt. % of copper sieve (No. 31, 21 mesh) based on the weight of the wool. The ratio of the wool weight to the bath weight is 1:15. The wool is treated in the bath at a temperature of 100° C. for 90 minutes and then is rinsed well in cold water.

The treated wool is then immersed in another bath which is a water solution comprising 10 g/l of sodium dithionite. The ratio of the wool weight to the weight of the bath is 1:15. The wool is treated in the bath at 100° C. for 60 minutes.

The wool fiber obtained exhibits an olive color and its electrical resistivity was found to be $5.5\times10^{-2}$ Ω-cm. The content of copper sulfide was found to be 5.2% by weight.

EXAMPLE 9

Silk yarn is scoured by immersing it in a bath which is a water solution of 2% sodium hydroxide at room temperature for 15 minutes. Then, it is squeezed by means of mangles to 40% of wet pickup. The scoured silk yarn is immersed in another bath which is a solution comprising 50 g/l of acrylonitrile. The ratio of the yarn weight to the weight of the bath is 1:20. The yarn is treated in the bath at a temperature of 55° C. for 90 minutes.

Without drying, the treated silk yarn is neutralized of its alkalinity. Then, it is rinsed with cold water to completely remove any unreacted materials and by-products.

Next, the treated silk yarn is immersed in another bath which is a water solution comprising 5 wt. % of cupric chloride, 10 wt. % of sodium dithionite, and 10 wt. % of sodium hydrogen sulfite based upon the weight of the yarn. The ratio of the weight of the yarn to the weight of the bath is 1:20. The yarn is treated in the bath at 100° C. for 60 minutes. Then, the yarn is rinsed well in cold water and then is dried completely.

The silk yarn obtained thereby exhibits an olive color and its electrical resistivity was found to be $2.1\times10^{-1}$ Ω-cm. The content of copper sulfide was found to be 3.3% by weight.

Each of the conducting fibers obtained in Examples 2 through 9 were subjected to X-ray analysis as in Example 1. The line of diffraction (Interfacial distance: 1.97 Å, 3.21 Å, and 2.79 Å) of digenite (empirical formula: $Cu_9S_5$) was also found for each of the conducting fibers of Examples 2–9. The copper ions were therefore adsorbed by those fibers in the form of copper sulfide as in Example 1.

We claim:

1. An electrically conducting fiber comprising a synthetic or natural starting fiber having cyanic groups introduced therein which is impregnated with copper sulfide.

2. An electrically conducting fiber as claimed in claim 1 wherein said starting synthetic fiber is selected from the group consisting of polyamide fiber, polyester fiber, rayon fiber, and cupro-ammonium fiber and said starting natural fiber is selected from the group consisting of wool, cotton, and silk.

3. An electrically conducting fiber as claimed in claim 1 wherein the starting fiber is a synthetic fiber.

4. An electrically conducting fiber as claimed in claim 1 wherein said starting fiber is an animal fiber or a vegetable fiber.

5. An electrically conducting fiber as claimed in claim 2 wherein said cyanic groups are introduced into said starting fiber by reaction with dicyandiamide, graft polymerization of acrylonitrile onto the starting fiber, cyanoethylization, mixed spinning, graft polymerized material spinning, or blocked polymerized material spinning.

6. An electrically conducting fiber as claimed in claim 1 or 2 wherein the weight percentage of copper sulfide is about 1% to about 30% based upon the weight of the starting fiber.

7. An electrically conducting fiber as claimed in claim 6 wherein said copper sulfide is cupric sulfide.

8. An electrically conducting fiber as claimed in claim 6 wherein said copper sulfide is cuprous sulfide.

9. An electrically conducting fiber as claimed in claim 6 wherein said copper sulfide is in the form of digenite which is adsorbed within the fiber.

10. An electrically conducting fiber as claimed in claim 6 which is dyed with a cationic dye.

11. A method of making an electrically conducting fiber comprising heat treating at least one synthetic or natural starting fiber having cyanic groups introduced therein with a copper compound, a reducing agent capable of reducing bivalent copper ions to monovalent copper ions, and a sulfur-containing compound to adsorb copper sulfide within said starting fiber containing said cyanic groups.

12. A method as claimed in claim 11 wherein heat treatment with the sulfur-containing compound is separate from and subsequent to heat treatment with the copper compound and the reducing agent.

13. A method as claimed in claim 11 wherein heat treatment with the copper compound, the reducing agent, and the sulfur-containing compound is within the same heat treating bath.

14. A method as claimed in claim 11 wherein said starting synthetic fiber is selected from the group consisting of polyamide fiber, polyester fiber, rayon fiber, and cupro-ammonium fiber and said starting natural fiber is selected from the group consisting of wool, cotton, and silk.

15. A method as claimed in claim 11 wherein the starting fiber is a synthetic fiber.

16. A method as claimed in claim 11 wherein said cyanic groups are introduced into said starting fiber by reaction with dicyandiamide, graft polymerization of acrylonitrile onto the starting fiber, cyanoethylization, mixed spinning, graft polymerized material spinning, or blocked polymerized material spinning.

17. A method as claimed in claim 11 wherein said copper compound is a cupric salt.

18. A method as claimed in claim 11 wherein said reducing agent is selected from the group consisting of metallic copper, hydroxylamine sulfate, ferrous sulfate, ammonium vanadate, furfural, sodium hypophosphate, glucose, and mixtures thereof.

19. A method as claimed in claim 11 wherein said sulfur-containing compound is selected from the group consisting of sodium sulfide, sulfur dioxide, sodium hydrogen sulfite, sodium pyrosulfite, sulfurous acid, dithionous acid, sodium dithionite, sodium thiosulfate, thiourea dioxide, hydrogen sulfide, $NaHSO_2.CH_2O.2H_2O$; $Z_nSO_2.CH_2O.H_2O$ and mixtures thereof.

20. A method as claimed in claim 11 wherein said heat treatment is at a temperature of from about 80° C. to about 120° C.

21. A method as claimed in claim 11 wherein said copper sulfide is in the form of digenite.

22. A method as claimed in claim 11 wherein said heat treatment is in an aqueous bath which contains a pH adjusting compound selected from the group consisting of inorganic and organic acids, salts of inorganic and organic acids, and mixtures thereof.

23. A method as claimed in claim 11 wherein the weight percentage of copper sulfide in the electrically conducting fiber is about 1% to 30% based upon the weight of the starting fiber.

* * * * *